US008258439B2

(12) United States Patent
Mak et al.

(10) Patent No.: US 8,258,439 B2
(45) Date of Patent: Sep. 4, 2012

(54) PORTABLE COOLING OR HEATING APPARATUS AND METHOD OF USING SAME

(75) Inventors: Gregory Mak, Hong Kong (HK); Per Johan Maurits Persson, Hong Kong (HK)

(73) Assignee: Top Creation (Asia) Ltd., Hong Kong (CN)

( * ) Notice: Subject to any disclaimer, the term of this patent is extended or adjusted under 35 U.S.C. 154(b) by 113 days.

(21) Appl. No.: 12/723,581

(22) Filed: Mar. 12, 2010

(65) Prior Publication Data

US 2011/0220633 A1 Sep. 15, 2011

(51) Int. Cl.
*H05B 3/02* (2006.01)

(52) U.S. Cl. ..... 219/482; 219/387; 219/520; 219/533; 219/549

(58) Field of Classification Search ..... 219/482, 219/465.1, 468.1, 496, 520, 531, 533
See application file for complete search history.

(56) References Cited

U.S. PATENT DOCUMENTS

| | | | | |
|---|---|---|---|---|
| 5,892,202 | A * | 4/1999 | Baldwin et al. | 219/387 |
| 6,018,143 | A * | 1/2000 | Check | 219/387 |
| 6,222,160 | B1 * | 4/2001 | Remke et al. | 219/387 |
| 7,491,912 | B1 * | 2/2009 | Check | 219/386 |
| 7,622,695 | B2 * | 11/2009 | DiPucchio et al. | 219/545 |

* cited by examiner

*Primary Examiner* — Tan T. Nguyen
(74) *Attorney, Agent, or Firm* — Leason Ellis LLP.

(57) ABSTRACT

A portable heating and cooling apparatus and method of using the same wherein a temperature-set material is secured in a housing with both rigid and expandable sides. The housing is placed within a container which is so configured such that there is little or no disruption of the contact between the rigid surface and an object to be heated or cooled, whether such contact is direct or via some thermal conductive material.

9 Claims, 10 Drawing Sheets

PORTABLE COOLING OR HEATING APPARATUS AND METHOD OF USING SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

The present invention relates to an apparatus and method for regulating the temperature of an object without the use of an external power supply.

Currently there are many materials that need to be transported that are sensitive to temperature variations. Common examples are food products, medical and chemical samples, human organs needed for transplant, as well as archeological and forensic samples. The common methods for preserving the constant temperature of transportable materials use active mechanical refrigeration, blocks of ice, thermal gels and packs, infrared reflective thermal materials and vacuum insulated flasks and other containers.

Each of these means of maintaining temperature has its own unique drawbacks. Mechanical refrigeration requires the use of heavy and cumbersome apparatus, including sealed containers, heat exchangers, and power sources. While effective at maintaining a narrow range of temperatures, it is difficult to provide a refrigeration solution that is easily portable. While there are vehicles that carry mechanical refrigeration units, these are generally larger highway vehicles and are difficult to take in to remote areas. Additionally, in order for portable mechanical refrigerators to function, they require a steady source of electricity. In the case of movable mechanical refrigerators, this power is supplied by a car or truck engine or a portable generator. Regardless of the mechanism, these power units require maintenance and fuel, and are not environmentally friendly.

Infrared reflective materials, are inefficient to the task of maintaining a temperature range. Generally they allow for some retention of the temperature range, but the design of the materials and their use results in thermal leakage.

Vacuum flasks operate by providing an inner and outer container while a sealed vacuum space is located between them. The vacuum space operates as an insulator preventing the transmission of thermal energy. In practice, the vacuum containers tend to be inefficient at maintaining temperature and are difficult to shape into a variety of container forms.

Known prior art portable cooling apparatuses are disclosed for example in U.S. Pat. No. 4,530,220 to Nambu et al. The respective disclosures are therein are incorporated by reference.

U.S. Pat. No. 4,530,220 to Nambu et al. discloses a deformable bag for use as a cooling medium. Nambu places small thermal gel pieces in a deformable bag so that they are able to migrate around the interior volume of the deformable bag. The bag is made of a flexible polyethylene or like material. The thermal gel pieces are of industry standard composition, however, they are provided in smaller than average pre-cast blocks. Upon use of the device in Nambu, the small blocks and flexible material conform to the rough dimensions of the material to be cooled. Nambu clearly is superior to the previously mentioned portable temperature maintaining apparatus. However there are clear drawbacks from using a device as described in Nambu. Both the natural ice and thermal compounds are unable to maintain their temperature within a narrow time range. In the example of Nambu, the smaller than average pre-cast blocks will have a large total surface area (when compared to the surface area of the thermal battery envisaged by the present invention), and will lose temperature more rapidly After a short period of time, the effectiveness of the overall material has been reduced. Furthermore, as they begin to warm, the ice or gel packs undergo dimensional transitions that decrease their direct contact with the object to be cooled. Therefore, what is needed is a method and apparatus that allows for an object to have prolonged contact with a portable cooling block.

Another difficulty with natural ice or a thermal battery is the fact that upon freezing, the thermal battery or the natural ice expands, but on losing cold, it will retract to its original shape and dimension. This makes it difficult to construct a suitable container for these items that will hold them securely whilst accommodating this change. If a container is made using the non-frozen dimensions of a thermal battery, it becomes difficult to construct a housing that will secure a frozen thermal battery due to unpredictable expansion. On the other hand, if the container is constructed according to expanded dimensions, upon the battery losing cold and retraction to its original unexpanded form and dimensions, extra space would result which may create a gap between the thermal battery and the goods to be stored thus losing intimate and regular contact, which will affect the transfer of cold temperature from the thermal battery to the goods. Therefore, what is needed is an apparatus that allows for a container and a thermal battery to be fitted securely despite the deformation process, so that there is continued contact between the thermal battery and the object needed to be kept within the temperature range.

The present invention proposes a method of maintaining a pre-set temperature range for objects over a long period of time without requiring an electrical power source. This is accomplished by making a thermal battery of special construction which is made by filling a specially designed housing with thermal gel or compound which can be pre-set at certain temperatures i.e. a thermal battery. Additionally, the present invention proposes an apparatus that ensures constant contact across the surface area of a thermal battery housing with either a thermal conductor or an object in need of a constant, pre-set temperature.

BRIEF SUMMARY OF THE INVENTION

The object of the present invention is to provide an improved method of maintaining temperature at a desired, pre-set level, for a long period of time and without the need for an external power source Another object of the present invention is an apparatus that can maintain an item within a specified temperature range for an extended period of time, is easily portable and lacks the need for an external power source. Still another object of the invention is to provide an apparatus that does not use or emit harmful gases or chemicals, does not melt and can be re-used by merely resetting the temperature of the thermal battery. Those skilled in the art will recognize and appreciate that further objectives are possible from the following description of the invention.

When a material, such as natural water-ice or a thermal battery, changes from a liquid to a solid state due to freezing, its dimensions change. The surface expands in a multitude of different directions with little or no predictability. This results in the thermal battery (which is filled with thermal compound) having an irregular surface. and non-uniform temperature gradients around the frozen material. Furthermore, when in-filling the thermal compound into the thermal battery housing during the manufacturing process, it is necessary to leave some space inside the battery housing to allow for thermal expansion of the thermal compound. The present invention uses various surfaces of differing rigidity so that expansion will proceed along a surface of less rigidity. The present invention makes it possible to reduce the amount of space needed inside the battery housing, such that a greater quantity of thermal compound can be in-filled into the thermal battery housing without the need to increase the size of the housing, and thus achieve a higher efficiency. Upon returning to an unfrozen state, the thermal compound, and the battery housing will return or retract to their original shape. The present invention uses these characteristics to provide a portable temperature controlling apparatus that can maintain a temperature range for a prolonged period of time relative to the prior art. The present invention accomplishes this with the use of a thermal battery in conjunction with a specifically designed housing.

In order to maintain a specified temperature range for the longest possible time, it is important to isolate a thermal battery from ambient temperature. This is accomplished by using an insulated container to house the thermal battery. The container is designed to be substantially air tight so that the ambient air temperature inside the container is close to that of the thermal battery. The substantially air tight container minimizes the effect that the ambient temperature can have on the thermal battery. In specific configurations of the present invention, the container has certain wall(s) which is removable (hereinafter referred to as "lid") The removable lid may be composed of the same insulating material as the rest of the container, or of other thermally non-conductive material, and the goods can be maintained in a temperature range by being placed inside the container directly against the thermal battery. Alternatively, it can be composed of a thermally conductive material, in which case, any object whose temperature is to be maintained, such as temperature sensitive goods, may be placed against the thermally conductive lid of the container which lies flush to the thermal battery.

In order to maintain maximum temperature conductivity and uniformity, the thermal battery must lie flush with the goods or the thermally conductive lid. This means that it is desirable to have few if any, air pockets interrupting contact between the thermal battery and the lid or between the thermal battery and the goods.

Therefore, the present invention proposes a thermal battery housing of specific construction so that at least one part of the housing surface is more rigid than the remaining surfaces. This is accomplished by using any material that exhibits a resistance to deformation under pressures likely to be encountered due to thermal expansion and retraction of the thermal battery. The remaining surface(s) would then be constructed of a material that exhibits less resistance to force than that exhibited by the rigid surface. As such, the rigid surface(s) and less rigid surface(s) work in concert to contain the thermal expansion and direct the expansion force to deform the less rigid surfaces. This enables the rigid surface(s) to maintain its original dimensions.

The present invention envisions that the thermal battery will be first processed in a freezer at a pre-set temperature to prepare it for use. During this process, expansion will take place to the thermal compound and to the thermal battery housing. As explained above, the special construction of the housing will enable certain rigid surface(s) and/or strategic areas of the housing to remain un-deformed, rendering the expanded shape and dimension of the thermal battery more predictable within a narrower range than in the prior art. The frozen and expanded thermal battery is placed inside the substantially air tight container. The container is designed so that the rigid non-deformed surface of the thermal battery is in constant contact with the goods, or the part of the container against which the goods are placed, e.g., the conductive lid. The design of the part of the container in contact with the thermal battery will vary according to the selected configuration to store or display the desired goods eg. bowl shaped for food or shaped in the form of the musical instrument to be store/displayed. The thermal battery could be secured in contact with the thermally conductive lid, or it could be in contact with another container surface eg, a vertical wall for cool storage of a vertical object As the thermal battery envisioned by the invention loses temperature and retracts to its original shape and dimensions, its rigid surface does not deform. This makes it possible to position the thermal battery so that its rigid surface remains in constant contact with the object, or desired part(s) thereof, or of such part of the container that is desired to be kept cool.

Thus the invention solves the problem of thermal batteries lacking constant contact with the container or the object to be maintained. Furthermore, the present invention allows for a manufacturer to predict, with better accuracy, the final size and shape of the thermal battery upon expansion and retraction, and to design with higher accuracy a container with higher cooling efficiency, and which will fit better the object goods it wishes to store/display

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE INVENTION AND PREFERRED EMBODIMENTS

Figure 1A:
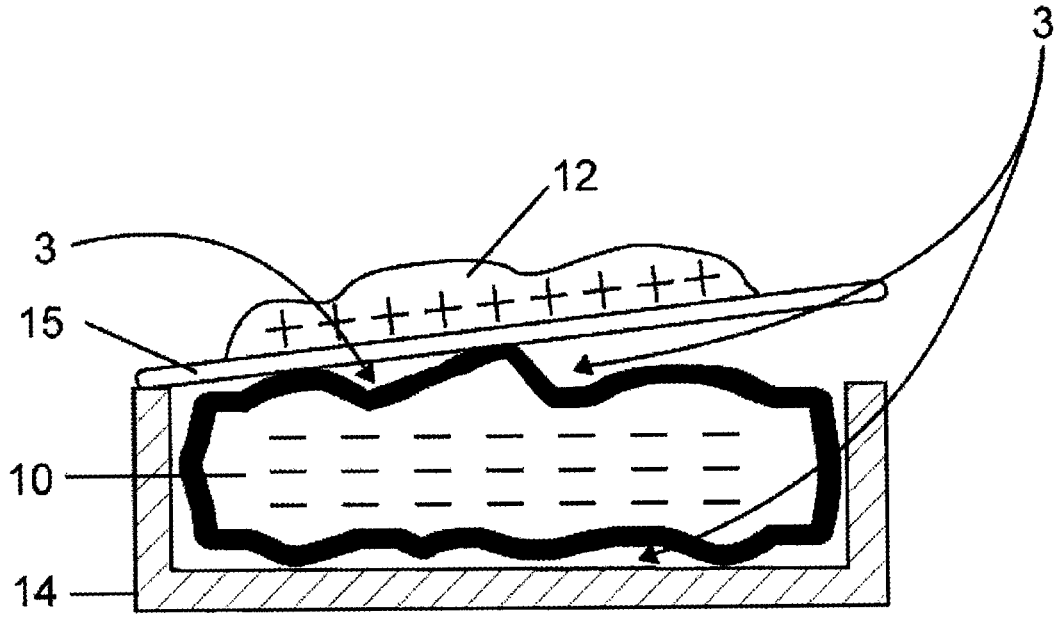
FIG. 1a (PRIOR ART)
FIGS. 1*a-b* depict a cross-section view of the prior art cooling apparatus.
Figure 1B:
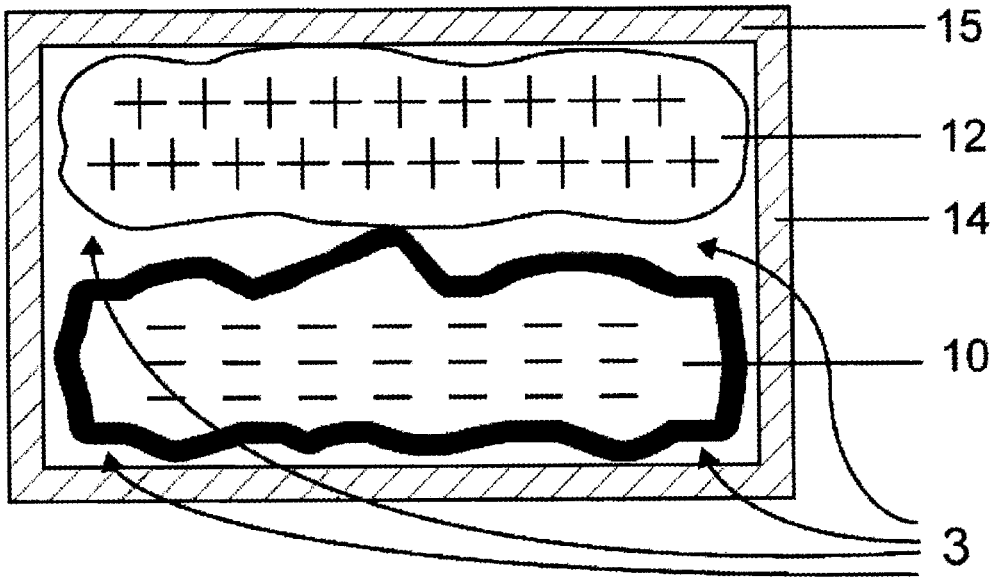
FIG. 1b (PRIOR ART)

Referring now to the drawings wherein like reference numerals designate corresponding parts throughout the several views. FIG. 1*a* illustrates the current state of the prior art as it relates to cooling trays. FIG. 1*b* illustrates the current state of the prior art as it relates to cooler boxes. FIGS. 2*a-d* illustrate various examples for the construction of the thermal battery as envisioned by the invention and 3*a-c* illustrate improved methods and apparatus for maintaining an object at a given temperature range while maintaining portability according to two embodiments of the present invention.

Specifically, as shown in FIG. 1, a thermal battery 10 as known in the prior art is depicted. This battery 10 is irregular in shape because it had undergone a freezing stage, and expanded in an unpredictable manner. It is located within a container 14 with a lid 15. It is contemplated that goods to be cooled will be placed on top of lid 15. Therefore, it is important that the thermal battery 10 maintain intimate contact with the lid 15. However, the prior art thermal battery 10, when subject to freezing temperatures, expands. As seen in FIG. 1*a*, the freezing process has caused a non-uniform expansion of the dimensions of the prior art thermal battery 10. As such, the prior art thermal battery does not maintain intimate contact against the walls of prior art container 14, and it can cause lid 15 to tip upward, creating air spaces 3 between the battery and the lid, with escape of the cool temperature.

As seen in FIG. 1*b*, the prior art thermal battery is placed within the enlarged container 14 with the object goods 12 to be cooled. However, its deformed shape due to non-uniform expansion upon freezing, makes it difficult to maintain constant contact across its surface with the object 12. This introduces air pockets 3 that act as insulators. This causes the goods or object(s) 12 that are to be cooled to experience non-uniform temperature ranges across the surface of the objects.

FIGS. 2*a-d* and 3*a-c* herein disclose what is new in the art.

FIGS. 2*a*-2*d*, show the present invention of thermal battery Z. The thermal battery Z housing has at least one surface or part of a surface 18 made of a rigid material that conducts thermal energy. The remaining surfaces 16 of the housing of thermal battery Z are made of materials that have less rigidity than the material or materials provided for rigid surface 18, or have greater thickness than the other surfaces 16. The housing is substantially filled with thermal compound 5*a*, leaving a space 5*b* for expansion of the thermal compound. When the thermal battery Z is exposed to freezing temperatures during the process of pre-setting its temperature, at least one rigid surface 18 maintains its pre-freezing shape and dimensions. The remaining surfaces 16 are allowed to deform due to thermal induced expansion. The thermal battery rigid surface 18 can be constructed out of a variety of materials known and foreseen by those skilled in the art, and using thermal compound material which can be pre-set to certain temperatures. Materials envisioned will have suitable characteristics of both rigidity and thermal conductivity; materials such as metals, alloys, silica composites, synthetic composites and plasticized materials are foreseen.

As seen in FIG. 2, the rigid surface 18 is a pre-designated part of the thermal battery housing and is of roughly planer dimensions, while the remaining surfaces 16 of the housing can be less uniform in dimensions. For example an embodiment envisioned in FIG. 2*a* proposes that the rigid surface 18 be substantially planer with respect to an upper and lower portion of the rigid surface 18 of the thermal battery Z. Those skilled in the art would appreciate that rigid surface 18 should have the same coefficient of expansion throughout. It can be designed with different shapes which best fits the purpose for and the shape, size and attributes of those object goods 12 to be maintained at a stable temperature. For example, in referencing FIG. 2*a*, the rigid surface 18 can be roughly rectangular, square, parallelogram or circular or ovoid in shape, or even irregular or patterned or punctuated with opening(s), with the container designed to accommodate that shape. The remaining less rigid surfaces 16 do not require that the surfaces be planer or uniform in density or rigidity. An embodiment of the present invention envisions the less rigid surfaces 16 of the thermal battery Z to be of a material that is less rigid relative to the rigid surface 18, such as a flexible material or a deformable material that possesses less rigidity than the rigid surface 18. Referring to FIG. 2*a*, the less rigid surface 16 depicted can be made of a flexible material such as, (without limitation), metal, foil, plastic or plasticized materials, synthetic or natural fibers or a flexible combination thereof.

Figure 2A:
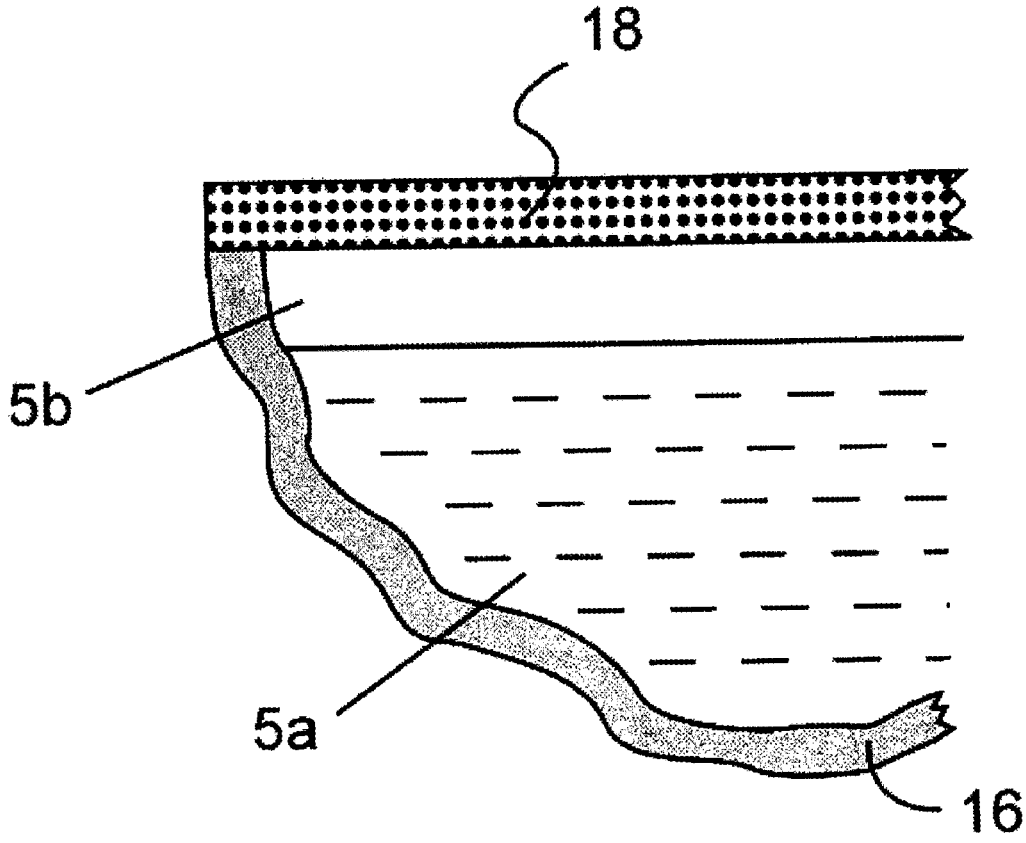
FIGS. 2*a*-2*e* depict a cross-section view of the thermal battery of the present invention.
Figure 2B:
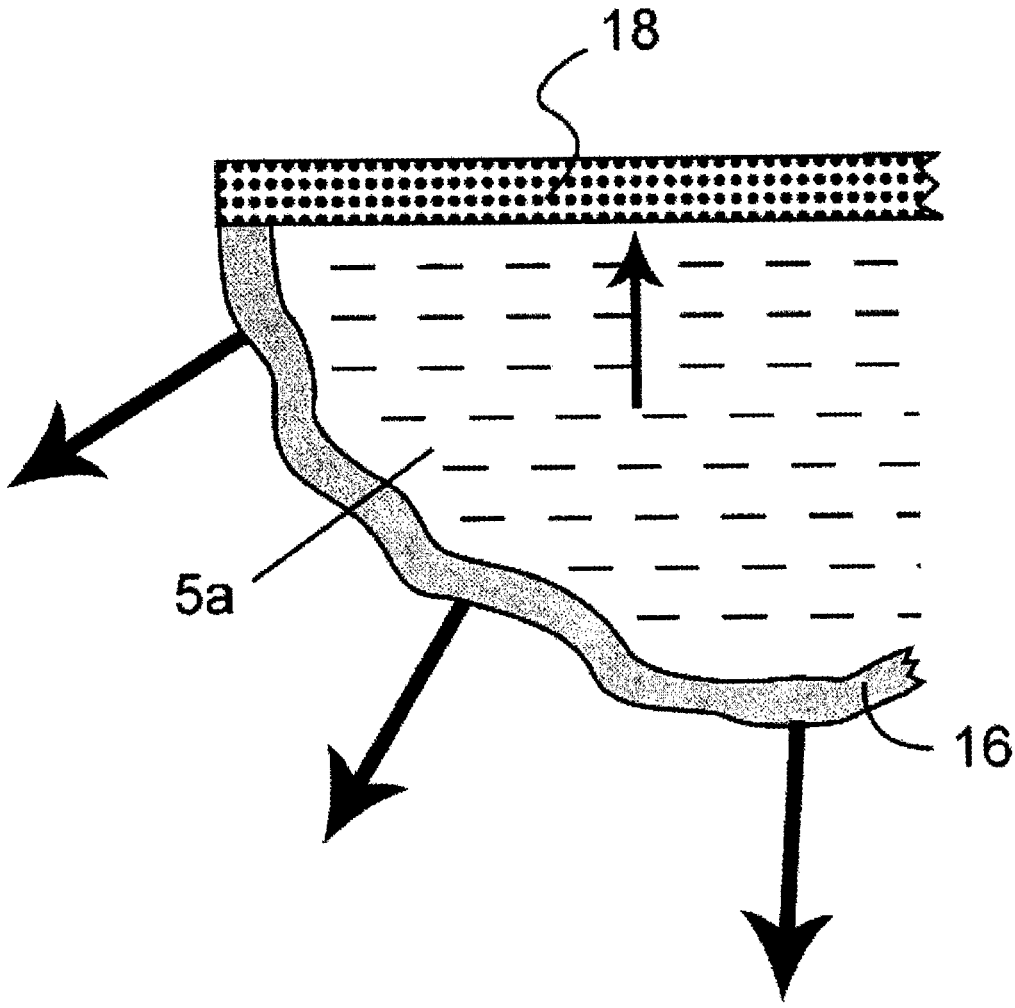

As shown in FIG. 2*b*, when the thermal battery Z undergoes freezing, the less rigid surfaces 16 expand outward in a non-predictable manner. The thermal compound 5*a* expands to fill up the expansion gap 5*b* inside the thermal battery housing. In contrast, the rigid surface 18 maintains its dimensions.

Figure 2C:
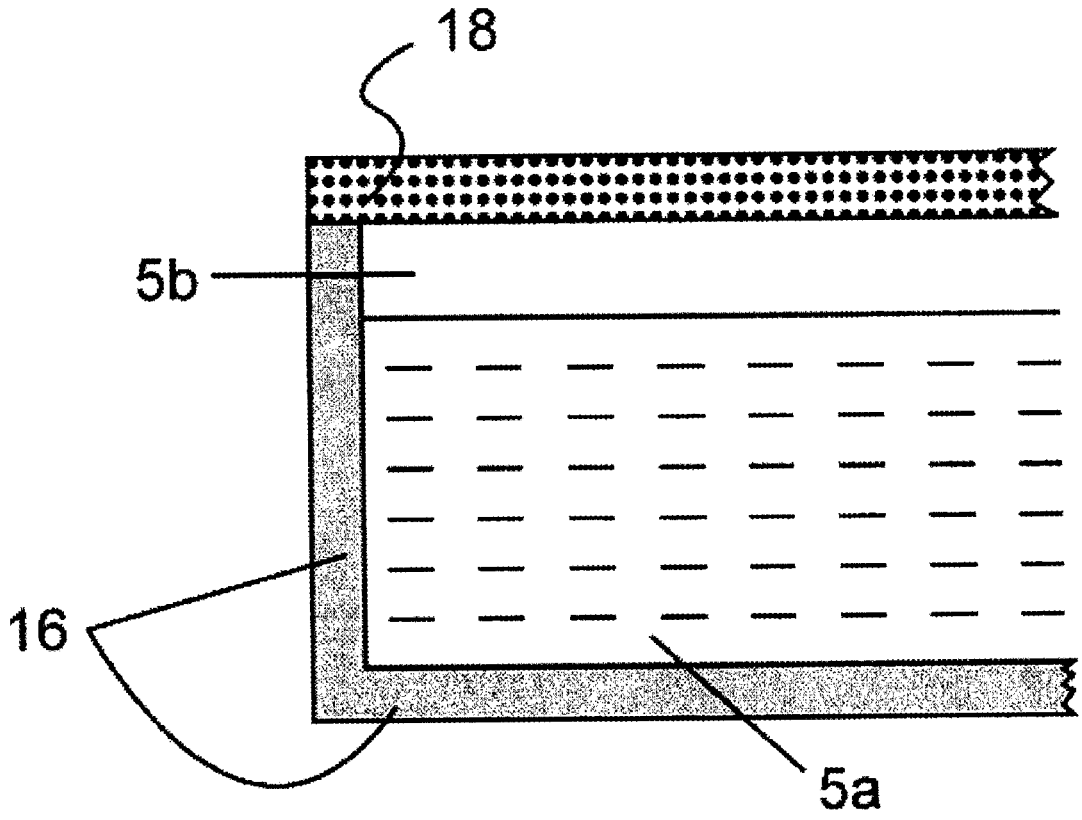

FIG. 2*c* envisions an embodiment wherein the less rigid surface(s) 16 possess(es) a substantially planer profile but are constructed of a material that will deform under expansion pressure. In this embodiment the less rigid surface(s) will maintain roughly planer dimensions while not under expansion pressure.

Figure 2D:
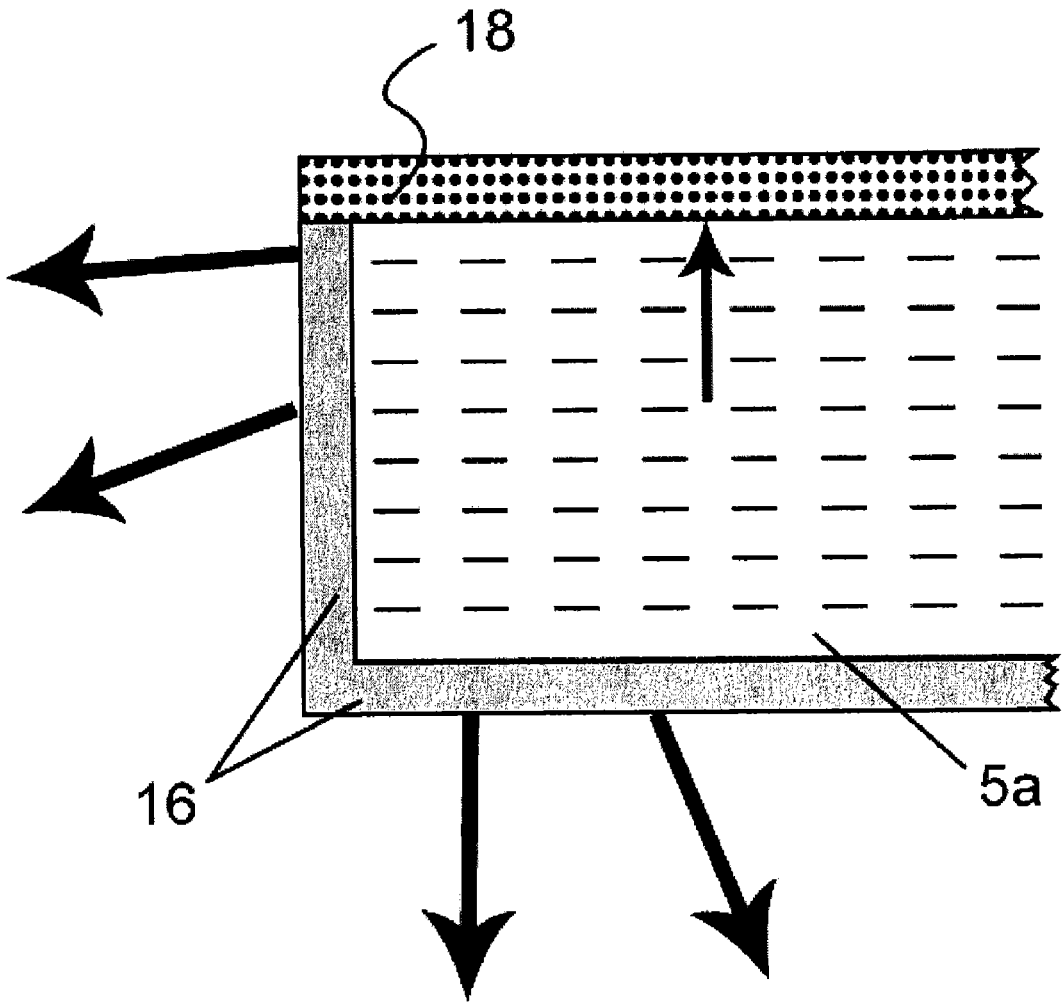

As seen in FIG. 2*d*, when the present invention uses substantially planar less rigid surface(s) 16, the expansion due to freezing forces the less rigid surfaces to expand outward in a uniform matter while the rigid surface 18 remains undistorted. The thermal compound 5*a* expands to fill up the expansion gap 5*b* inside the thermal battery housing.

Figure 2E:
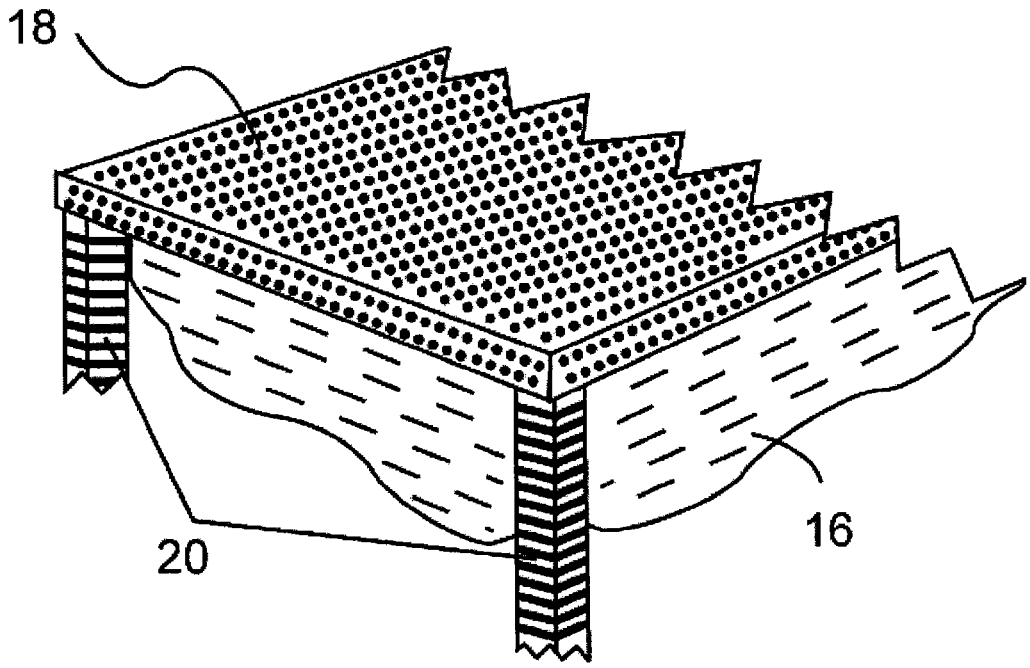

FIG. 2*e* shows an isometric view of an alternative structure of thermal battery Z where the less rigid surfaces 16 are supported by a framework of rigid support structures 20 made of more rigid material, which will be able to resist deformation upon freezing at the desired points or areas, such as strategic corners. When the thermal battery Z deflects to its original shape upon losing temperature, these struts will brace up the thermal battery Z at the desired points, allowing the thermal battery to remain stable in shape or dimension at those points, e.g. maintaining original height of the battery.

Figure 3A:
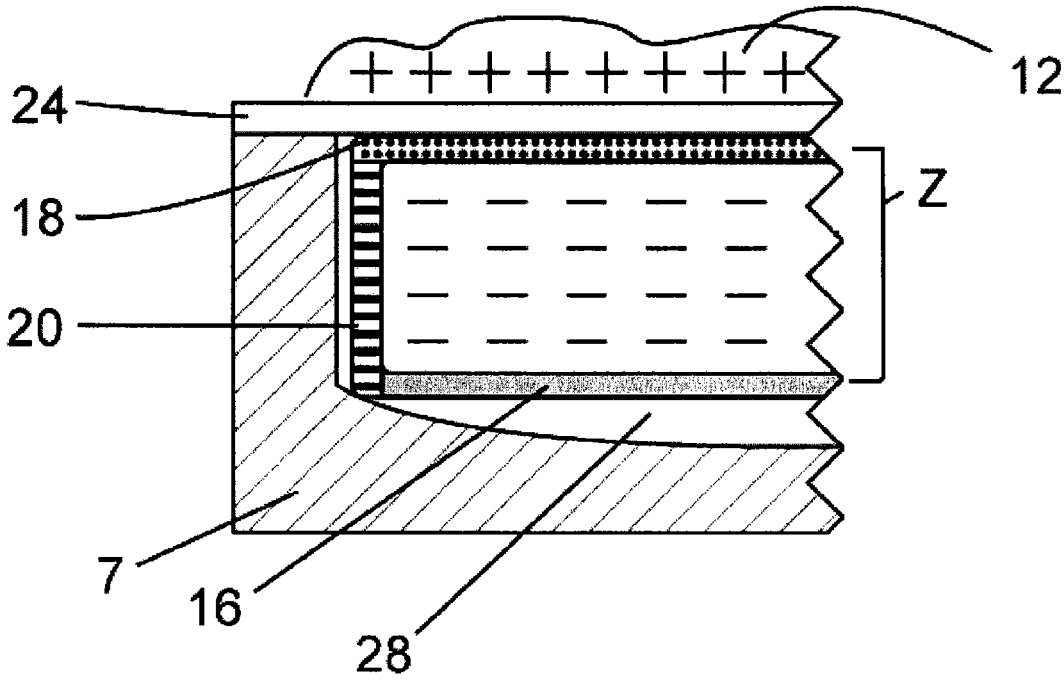
FIGS. 3*a*-3*c* depict a cross-section view of the thermal battery of the present invention located within a container of the present invention.

Referring to FIG. 3*a*, it depicts a cross sectional view of an embodiment of the present invention as a substantially air tight container 7 with thermal battery Z. The thermal battery Z is placed inside the container 7, wherein the dimensions of the container are such that there is an expansion gap 28 between the less rigid surfaces 16 and the container 7. The container also posseses a substantially air tight lid 24, which is composed of a thermal conductive material and is substantially planer in dimensions. In the envisioned embodiment, the thermal battery Z is set to a pre-determined temperature by freezing (not shown) during which process it expands along the less rigid surfaces 16 allowing rigid surface 18 to remain un-deformed. The expanded thermal battery Z is then placed in the container 7, the lid 24 is secured and the object 12, which is to be thermally maintained, is placed on top of the lid 24. In this embodiment, the rigid surface 18, the lid 24 and the object 12 to be maintained are all in constant contact with one another regardless of the deformations that take place as the thermal battery Z looses or gains thermal energy. The optional rigid support structure 20 as seen in FIG. 2*e* is incorporated into the housing of the thermal battery Z. This rigid support structure can be added to the housing depending on a specific configuration to insure that the expansion only occurs in certain pre-determined direction or area, whilst maintaining the shape or height of the thermal battery at certain strategically desired points or areas The rigid support structure can also be used to position the thermal battery above the expansion gap 28, so that the rigid surface 18 is parallel to the lid 24. Upon retraction on losing temperature, thermal battery Z will nevertheless retain its height due to rigid support structure 20, and thus, rigid surface 18 will not break contact with lid 24.

Figure 3B:
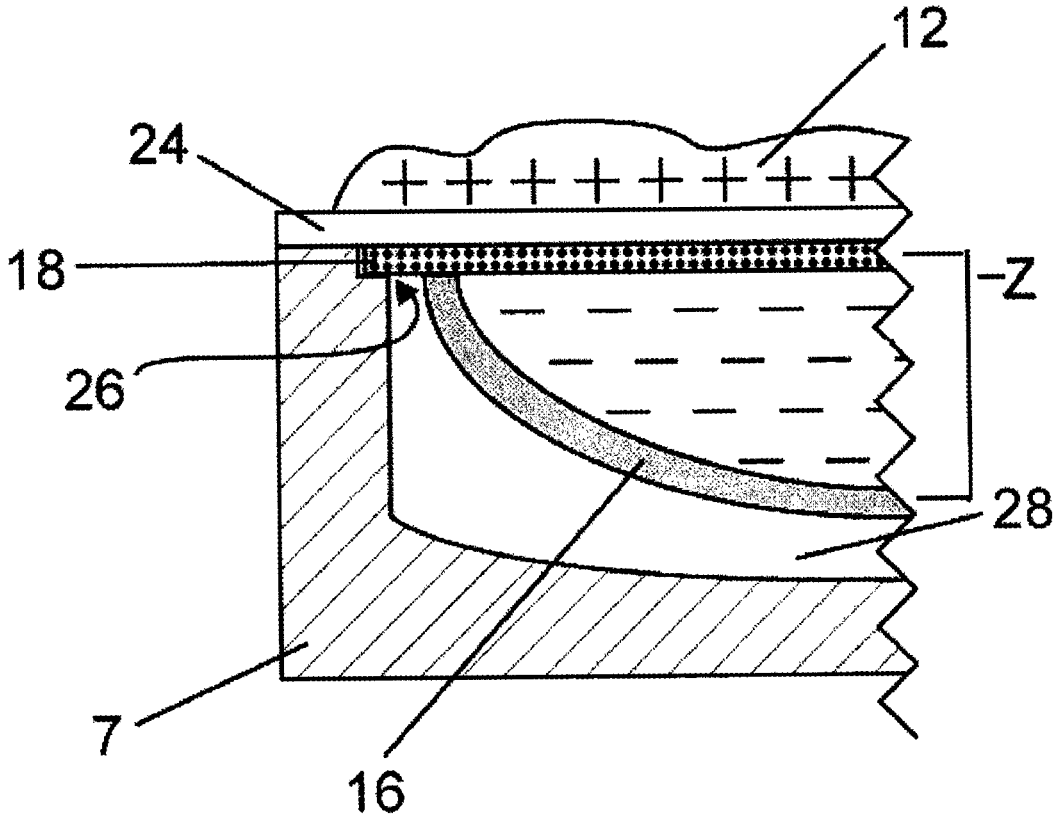

FIG. 3*b* illustrates an alternate embodiment wherein the thermal battery Z is constructed from a housing comprising a rigid surface 18 and a less rigid surface 16, wherein the less rigid surface 16 is of a non-planer shape and comprised of flexible material. In this embodiment, it is envisioned that the rigid surface has means 26 of securing the rigid surface 18 to the sides of the container. These means are envisioned as tongue and grove supports, tabs, brackets or other such supports. When the rigid surface 18 is secured by securing means 26, the thermal battery Z can be suspended above the expansion gap 28. By this action, the thermal battery Z does not require a rigid support structure 20 to maintain parallel orientation with the lid 24. In this embodiment, the object goods 12 are again placed upon the lid 24.

Figure 3C:
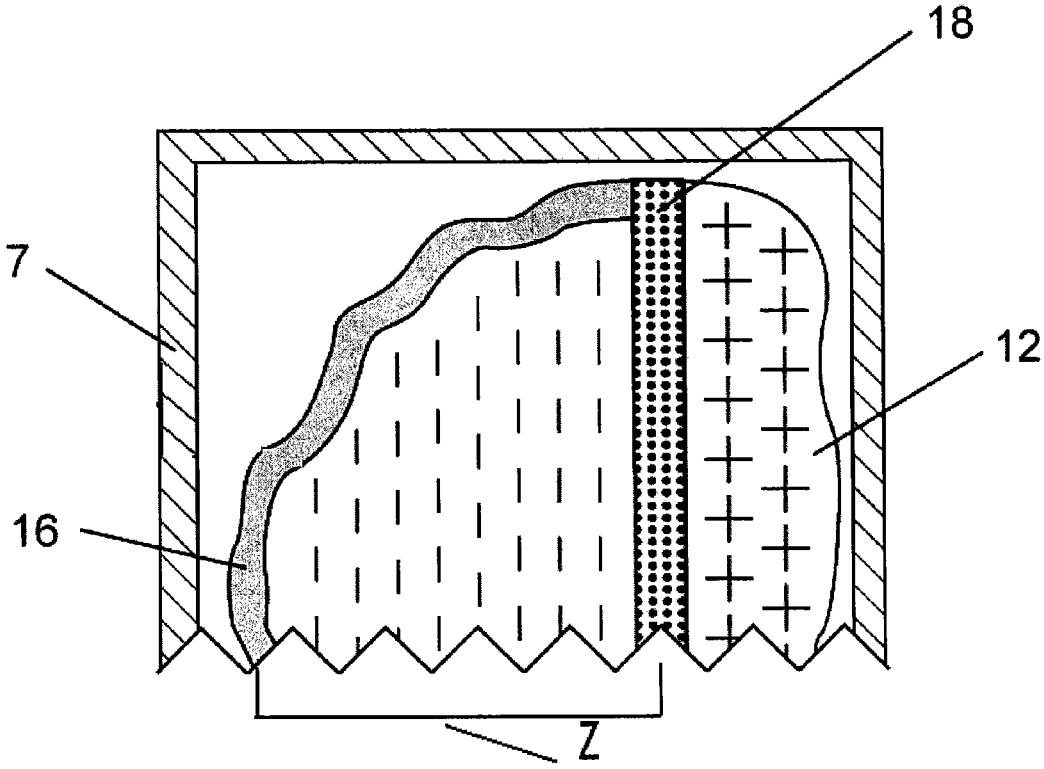

As seen in FIG. 3*c*, a further alternative embodiment has the thermal battery Z constructed from a housing as described in FIGS. 2*a-b*. This embodiment envisions that the thermal battery Z is placed inside container 7. The goods 12 are also placed inside the container 7 and in contact with the rigid surface 18, either directly or through some conductive material Te t By shaping and/or positioning the rigid surface 18 according to the dimensions and positioning of goods 12, it is possible to maintain a constant contact along the rigid surface 18 with the desired part of the goods 12. Various means may be used to secure goods 12 to the rigid surface 18 eg. by force of gravity in a plate or bowl form when lying horizontal, or by means of wrap around devices or other means such as clamps springs or support of the type of 20 or otherwise. By way of example, where the object goods 12 are desired to be stored/displayed in a vertical position, or at an angle, it is possible in the present invention to position the rigid surface 18 such that it may accordingly remain flush against such goods, whether for the whole length or along such part(s) as may be desired Additionally, in this embodiment the lid 24 may be fashioned out of the same material as the rest of container 7, or from other non thermal conductive material eg. glass for display purposes.

A further embodiment (not shown) of the present invention is envisioned wherein the thermal battery Z undergoes heating to a pre-determined temperature and is then placed in the container. In this manner the device is capable of maintaining the object 12 at a temperature that exceeds that of ambient for a prolonged period of time. This is accomplished by the rigid surface 18 maintaining its planer shape regardless of the thermal expansion or contraction undergone by the remainder of the thermal battery Z. The same principles will apply mutatis mutandis.

The present invention is also directed to a method of maintaining an object at a pre-determined temperature by using a thermal battery and a substantially air tight container as described in FIGS. 3*a-c*. The method comprises setting the pre-determined temperature of a thermal battery Z, then securing the thermal battery Z inside a substantially airtight container 7 so that the thermal battery Z will be in constant contact with a thermally conductive lid 24. The object goods 12 is then placed in contact with the thermally conductive lid 24. The rigid surface 18 maintains contact across its surface area with the lid 24 while the less rigid surface expands into an expansion gap 28 depending on the temperature of the thermal battery. In an alternative method, the object goods 12 can be placed inside the substantially air tight container, in contact with the rigid surface 18, whether directly or through some thermal conductive material.

Based upon the discussion above, the thermal battery and container of the present invention solve the problems and overcomes the drawbacks and deficiencies of prior art cooling trays and cooling containers by providing a thermal battery having a housing that has a rigid surface and other less rigid surface(s) designed so that thermal expansion deforms only the less rigid portion(s) of the thermal battery. The insertion of the thermal battery inside the container of the present invention allows the thermal battery to be supported while maintaining constant contact with a thermally conductive lid. In this manner, the thermal temperatures are transmitted from the thermal battery to the object goods by utilizing the entire surface area of the rigid surface. This allows for a uniform conduction of thermal energy from the thermal battery to the object goods and ensures that the object goods are maintained within the specified temperature range for a significant period of time.

Although particular embodiments of the invention have been described in detail herein with reference to the accompanying drawings, it is to be understood that the invention is not limited to those particular embodiments, and that various changes and modifications may be effected therein by one skilled in the art without departing from the scope of spirit of the invention as defined in the appended claims.

What is claimed as new and desired to be protected by Letters Patent of the United States is:

1. A portable heating or cooling apparatus comprising:

a thermal battery comprising a temperature-set material configured inside a housing having at least one substantially rigid surface which resists deformation when acted upon by an external force generated by thermal expansion and retraction of the temperature-set material, and at least one flexible surface wherein the flexible surface will deform under the influence of the external force prior to the deformation of the rigid surface, and a substantially air tight container configured to have a bottom part and a removable lid;

wherein the rigid surface of the thermal battery is secured within the substantially air tight container in intimate contact with the removable lid.

2. The portable temperature regulating apparatus of claim 1, wherein the thermal battery housing is further configured to have a rigid support structure, wherein the rigid support structure enables the flexible surface to deform in a pre-determined direction.

3. The portable temperature regulating apparatus of any of claims 1 and 2, wherein the removable lid is further characterized as being made of thermally conductive material.

4. The portable temperature regulating apparatus of claim 3, wherein there is an expansion gap located between at least one flexible surface and the substantially air-tight container.

5. The portable temperature regulating apparatus of claim 4, wherein the rigid surface of the thermal battery is secured to the substantially air-tight container by a suspending means such that the flexible surfaces are not in contact with the substantially air-tight container.

6. A portable heating or cooling apparatus comprising:

a thermal battery comprising a temperature-set material configured inside a housing having at least one rigid surface which resists deformation when acted upon by an external force generated by thermal expansion and retraction of the temperature-set material, and at least one flexible surface wherein the flexible surface will deform under the influence of the external force prior to the deformation of the rigid surface, and a substantially air tight container configured to have an insulated body and a thermally conductive removable lid.

7. A method of maintaining temperature control of an object by using a thermal battery and a substantially air-tight container with a removable thermally conductive lid, comprising:

providing a thermal battery with a rigid surface and a more flexible surface;

setting the predetermined temperature of a thermal battery;

securing the thermal battery inside a substantially airtight container so that the rigid surface of the thermal battery is in constant contact with the thermally conductive lid;

placing the object to be temperature maintained in contact with the thermally conductive lid that is in constant contact to secured to the rigid surface of the thermal battery; and maintaining contact of the lid across the surface area of the rigid surface of the thermal battery, while the more flexible surface expands into or contracts from an expansion gap in the container.

8. A method of maintaining temperature control of an object by using a thermal battery and a substantially air-tight container as described in claim 7 wherein:

during the securing step the thermal battery is secured inside a substantially airtight container so that the flexible surfaces are not in contact with the container and that the rigid surface of the thermal battery will be in constant contact with the thermally conductive lid.

9. A method of maintaining temperature control of an object by using a thermal battery and a substantially air-tight container comprising:

providing a thermal battery with a rigid surface and a more flexible surface;

setting the predetermined temperature of a thermal battery;

placing the thermal battery inside a substantially airtight container;

placing the object to be temperature maintained in contact with the rigid surface of the thermal battery within the container either directly or through some thermal conductive material;

securing the thermal battery to the container; and maintaining contact with the object across the surface area of the rigid surface, while the less rigidity surface expands or contracts.

* * * * *